US011383475B2

(12) United States Patent
Burns et al.

(10) Patent No.: US 11,383,475 B2
(45) Date of Patent: Jul. 12, 2022

(54) DUNNAGE CONVERSION MACHINE AND METHOD

(71) Applicant: Ranpak Corp., Concord Township, OH (US)

(72) Inventors: Shawnasee E. Burns, Rock Creek, OH (US); William D. Bruck, Lyndhurst, OH (US)

(73) Assignee: Ranpak Corp., Concord Township, OH (US)

( * ) Notice: Subject to any disclaimer, the term of this patent is extended or adjusted under 35 U.S.C. 154(b) by 454 days.

(21) Appl. No.: 16/098,642

(22) PCT Filed: May 2, 2017

(86) PCT No.: PCT/US2017/030527
§ 371 (c)(1),
(2) Date: Nov. 2, 2018

(87) PCT Pub. No.: WO2017/192503
PCT Pub. Date: Nov. 9, 2017

(65) Prior Publication Data

US 2020/0307141 A1 Oct. 1, 2020

Related U.S. Application Data

(60) Provisional application No. 62/331,411, filed on May 3, 2016.

(51) Int. Cl.
*B31D 5/00* (2017.01)

(52) U.S. Cl.
CPC ..... *B31D 5/0043* (2013.01); *B31D 2205/007* (2013.01); *B31D 2205/0023* (2013.01);
(Continued)

(58) Field of Classification Search
CPC ..... B31D 2205/0058; B31D 5/0043; B31D 2205/0052
See application file for complete search history.

(56) References Cited

U.S. PATENT DOCUMENTS 3,603,216 A 9/1971 Johnson
5,593,376 A 1/1997 Armington et al.
(Continued)

OTHER PUBLICATIONS

The International Search Report and The Written Opinion of The International Searching Authority for Corresponding International Application PCT/US2017/030527 dated Oct. 7, 2017.

*Primary Examiner* — Anna K Kinsaul
*Assistant Examiner* — Daniel Jeremy Leeds
(74) *Attorney, Agent, or Firm* — Renner, Otto, Boisselle & Sklar, LLP

(57) ABSTRACT

A method of making a dunnage product includes the following steps: (a) converting a sheet stock material into a lower density strip of dunnage having a width and a height that is less than the width; and (b) cutting the strip of dunnage to form a discrete dunnage product of a desired length by cutting across less than the width of the strip of dunnage to maintain a connection between the strip of dunnage and the discrete dunnage product. The connection between respective dunnage products in a string of connected dunnage products keeps the dunnage products together, in the order in which they were produced, and helps to ensure that the dunnage products do not shingle and can assist in feeding the dunnage products to a packing station.

18 Claims, 3 Drawing Sheets

(52) U.S. Cl.
CPC ..... *B31D 2205/0035* (2013.01); *B31D 2205/0058* (2013.01); *B31D 2205/0082* (2013.01); *B31D 2205/0088* (2013.01)

(56) References Cited

U.S. PATENT DOCUMENTS

| | | | | |
|---|---|---|---|---|
| 6,311,596 | B1 * | 11/2001 | Ratzel | B26D 1/30 493/352 |
| 7,407,471 | B2 * | 8/2008 | Demers | B26F 3/02 493/407 |
| 8,016,735 | B2 * | 9/2011 | Wetsch | B31D 5/0052 493/464 |
| 8,845,502 | B2 * | 9/2014 | Keller | B65B 3/003 493/30 |
| 2003/0040416 | A1 | 2/2003 | Lucassen et al. | |
| 2004/0266598 | A1 | 12/2004 | Toth | |
| 2008/0076653 | A1 * | 3/2008 | Shaw | B31D 5/006 493/464 |
| 2008/0193263 | A1 * | 8/2008 | Wetsch | B65H 20/00 414/222.04 |
| 2008/0261794 | A1 * | 10/2008 | Slovencik | B26D 5/14 493/370 |
| 2009/0026306 | A1 * | 1/2009 | Kempster | B65H 35/0006 242/593 |
| 2011/0052875 | A1 * | 3/2011 | Wetsch | B31D 5/0052 428/152 |
| 2012/0165172 | A1 * | 6/2012 | Wetsch | B65H 16/005 493/352 |
| 2013/0092716 | A1 * | 4/2013 | Wetsch | B31D 5/0043 225/77 |
| 2014/0274645 | A1 * | 9/2014 | Wetsch | B65H 45/06 493/360 |

* cited by examiner

DUNNAGE CONVERSION MACHINE AND METHOD

RELATED APPLICATIONS

This application is a national phase of International Application No. PCT/US2017/030527, filed May 2, 2017, and published in the English language, and which claims priority to U.S. Application No. 62/331,411, filed May 3, 2016, both which are hereby incorporated herein by reference in their entireties.

FIELD OF THE INVENTION

This invention is related to dunnage machines, and more particularly to machines and methods for converting a sheet stock material into a relatively less dense dunnage product.

BACKGROUND

In the process of shipping one or more articles in a container, dunnage products typically are placed in the container to fill voids and to protect the articles during shipment. Such dunnage products can be made of plastic, such as air bags or bubble wrap, or paper, such as a crumpled paper dunnage product.

A dunnage conversion machine converts a sheet stock material into a relatively lower density dunnage product. The sheet stock material typically is provided as a continuous sheet. This enables a dunnage conversion machine to convert the sheet stock material into a substantially continuous strip of dunnage without a lot of down time to replenish the supply of stock material. Discrete dunnage products of any length then may be severed from the strip. Some examples of machines that convert plastic or paper sheets into dunnage products are described in U.S. Pat. Nos. 7,950,433 and 7,220,476.

Dunnage conversion machines employ a variety of cutting mechanisms to sever dunnage products from the converted strip of dunnage. Sometimes a row of perforations are formed across the sheet stock material or the converted strip of dunnage and then a packer manually separates the dunnage product from the strip of dunnage by tearing along the perforations. And some strips of dunnage are made of a material that can be manually torn without perforations.

SUMMARY

The present invention provides a dunnage conversion machine, system, and method that incompletely severs dunnage products from strips of dunnage to facilitate delivery of the dunnage products from the conversion machine to a packer. In particular, the conversion machine only partially cuts across the width of the dunnage product, leaving the remainder to be manually separated by a packer. This helps to maintain the dunnage products in a desired sequence and facilitates more orderly delivery.

For example, in a situation where dunnage products are provided to a delivery chute or conveyor, successive dunnage products output into the chute tend to shingle, with successive dunnage products riding up over or sliding under preceding dunnage products. This can lead to dunnage products falling off the chute or not being provided in a correct order. The different dunnage products can have different lengths, in which case the order in which they are supplied may be important for the packer to place in a container in the proper order. The connection between respective dunnage products in the string of connected dunnage products provided by the present invention keeps the dunnage products together and helps to ensure that the dunnage products do not shingle or fall out of the order in which they were produced.

As another example, when dunnage products are being dispensed to a bin for subsequent retrieval by a packer, the weight of the leading dunnage products extending into the bin applies tension to uncut portions connecting the leading and subsequent dunnage products. This tension typically is insufficient to cause the dunnage products to separate, but is sufficient to ensure that the dunnage products travel to the bin without shingling or any other problems. Packers separate discrete dunnage products from the leading end of the string of dunnage products as needed.

More specifically, summarizing the claimed invention, the present invention provides a dunnage conversion machine including a conversion assembly that converts a sheet stock material into a lower-density strip of dunnage having a width and a height that is less than the width, a cutting assembly downstream of the conversion assembly to cut the strip of dunnage to form a discrete dunnage product of a desired length, and a controller that controls the operation of the cutting assembly. The controller is configured to control the cutting assembly to cut across less than the width of the strip of dunnage to maintain a connection between the strip of dunnage and the discrete dunnage product.

The dunnage conversion machine may further include elements that define a path for the strip of dunnage through the cutting assembly.

The cutting assembly may include a cutting blade. The controller may be configured to control the cutting assembly to move the cutting blade into the path from a lateral side of the path.

The path may be configured to accommodate the width of the strip of dunnage extending between lateral sides of the path. The cutting assembly may be configured to cut between 25% and 95% of the path, the cutting assembly may be configured to cut between 40% and 80% of the path, and the cutting assembly may be configured to cut between 50% and 75% of the path.

The present invention also provides a packaging system that includes the dunnage conversion machine, and an accumulator adapted to receive multiple discrete dunnage products connected to the strip.

The accumulator may include a linear chute.

The accumulator may include a bin that can hold multiple discrete dunnage products connected to the strip.

The present invention further provides a method of making a dunnage product, that includes the following steps: (a) converting a sheet stock material into a lower density strip of dunnage having a width and a height that is less than the width; and (b) cutting the strip of dunnage to form a discrete dunnage product of a desired length by cutting across less than the width of the strip of dunnage to maintain a connection between the strip of dunnage and the discrete dunnage product.

The method may include moving a cutting blade across the width of the strip of dunnage.

The method may include the step of advancing the strip of dunnage in a longitudinal direction transverse the width of the strip of dunnage, and repeating the cutting step over time to form a series of longitudinally-spaced cuts that define a plurality of discrete dunnage products, each of a desired length, each connected to the strip of dunnage.

The cutting step may include cutting the strip of dunnage at longitudinally-spaced locations that are not equally spaced.

The method may include step of supplying a paper sheet stock material to a conversion assembly for the converting step.

The converting step may include randomly crumpling the sheet stock material.

The method may include the step of accumulating a plurality of discrete dunnage products connected to the strip of dunnage.

The method may include the step of separating a discrete dunnage product from the strip of dunnage. The separating step may be performed manually.

The present invention may further provide a dunnage conversion machine, that includes (a) means for converting a sheet stock material into a lower density strip of dunnage having a width; and (b) means for cutting the strip of dunnage to form a discrete dunnage product of a desired length by cutting across less than the width of the strip of dunnage to maintain a connection between the strip of dunnage and a discrete dunnage product.

The means for converting may include a conversion assembly that converts a sheet stock material into a lower-density strip of dunnage having a width.

The means for cutting may include a cutting assembly downstream of the conversion assembly to cut the strip of dunnage to form a discrete dunnage product of a desired length, and a controller that controls the operation of the cutting assembly. The controller may be configured to control the cutting assembly to cut across less than the width of the strip of dunnage to maintain a connection between the strip of dunnage and the discrete dunnage product.

The foregoing and other features of the invention are hereinafter fully described and particularly pointed out in the claims, the following description and the annexed drawings setting forth in detail one or more illustrative embodiments of the invention. These embodiments, however, are but a few of the various ways in which the principles of the invention can be employed. Other objects, advantages and features of the invention will become apparent from the following detailed description of the invention when considered in conjunction with the drawings.

DETAILED DESCRIPTION

Figure 1:
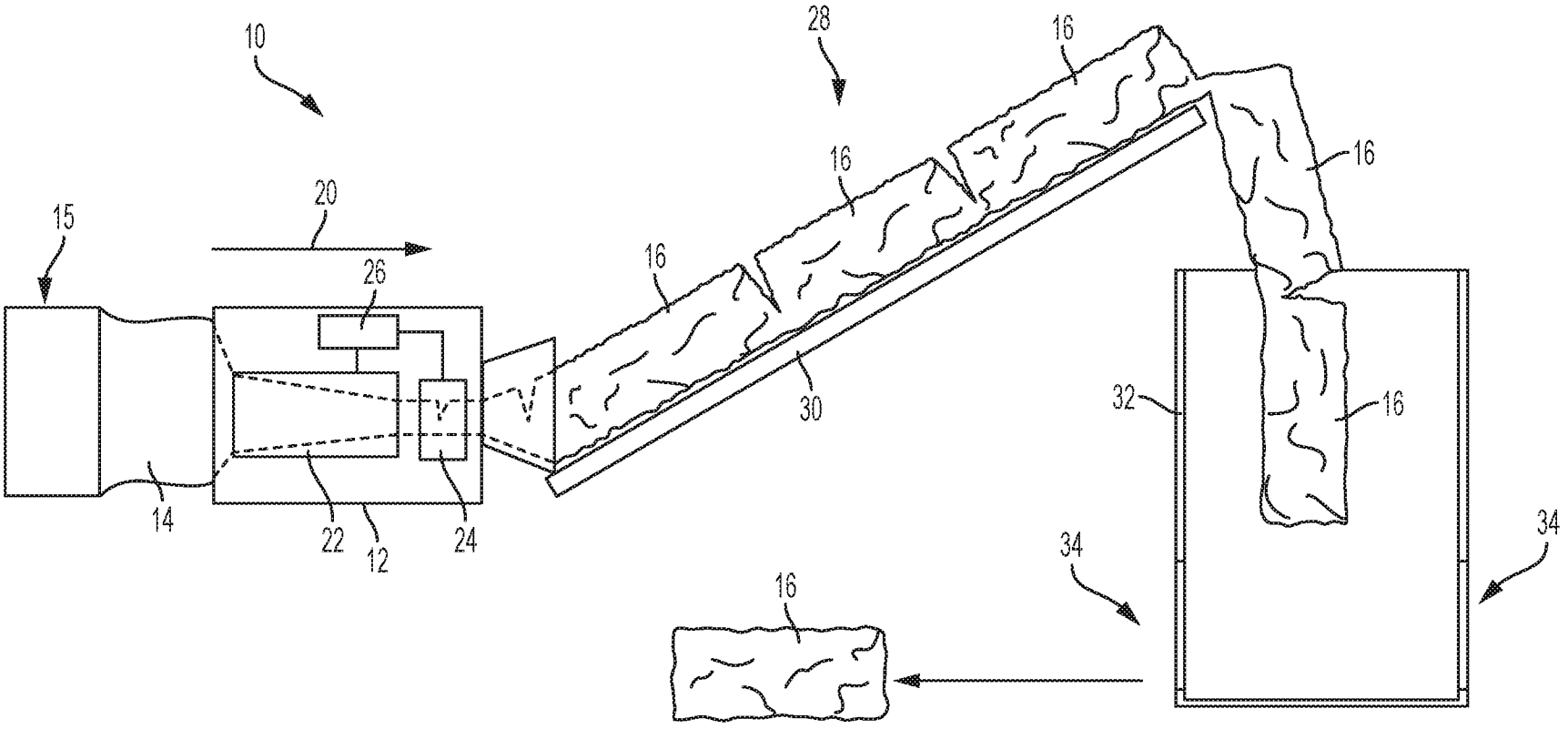
FIG. 1 is a schematic illustration of a packaging system in accordance with the invention.
Figure 2:
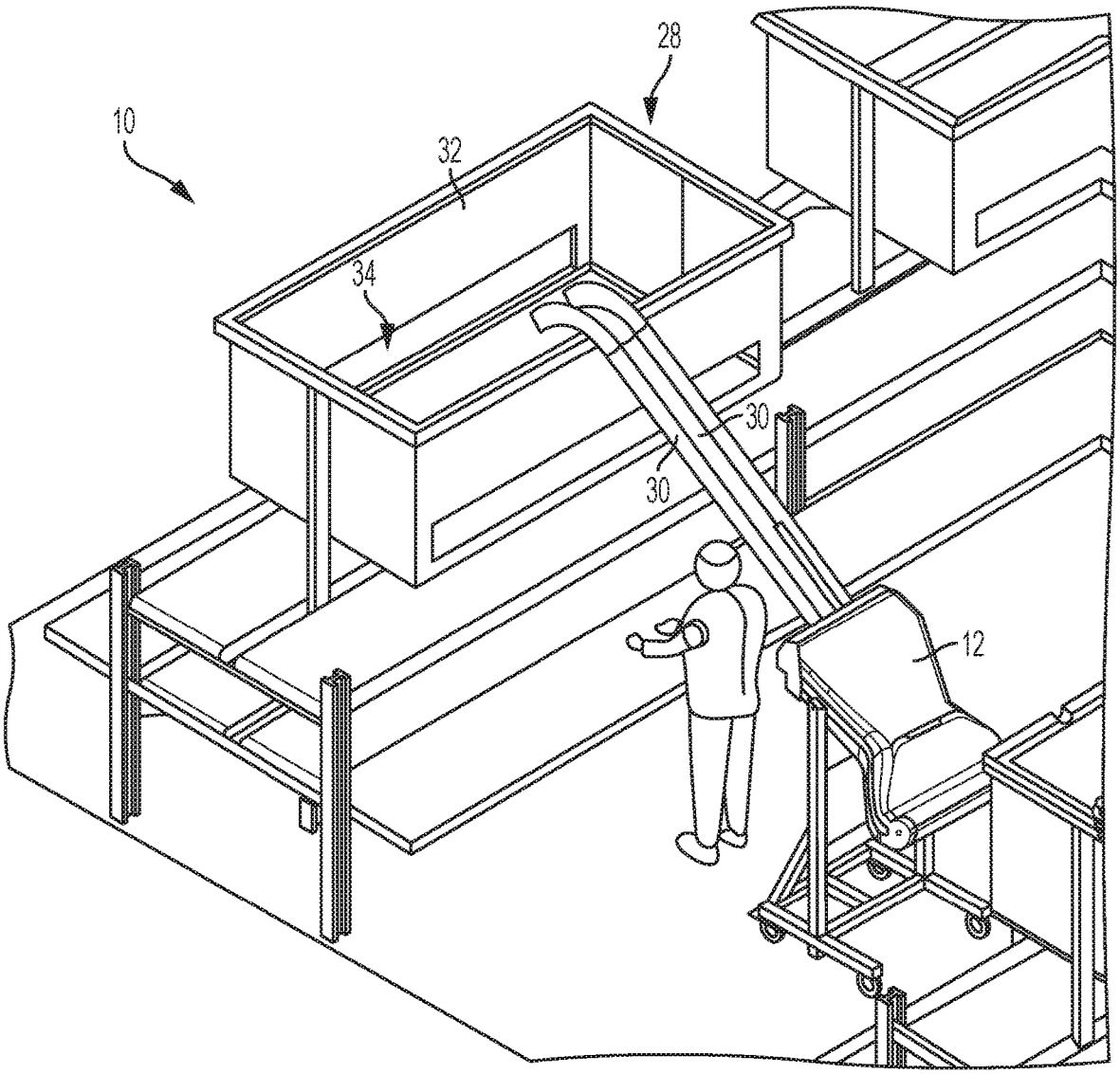
FIG. 2 is a perspective view of an exemplary packaging system.
Figure 3:
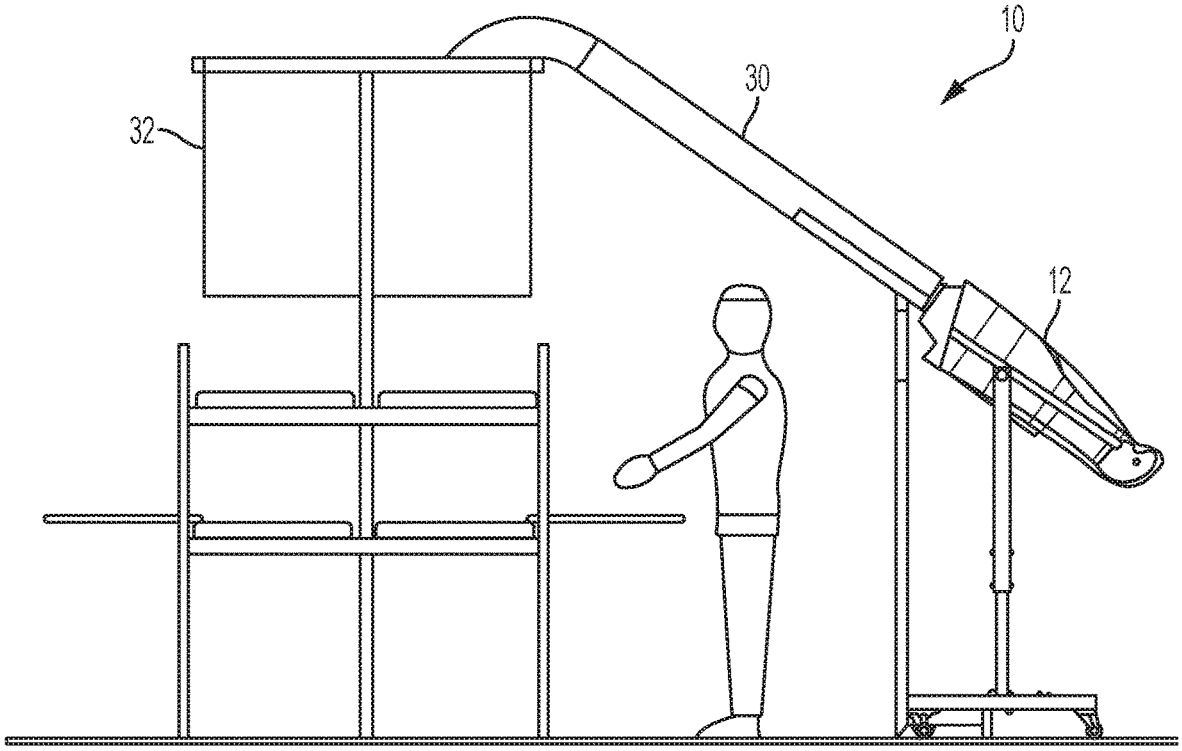
FIG. 3 is an elevation view of the system of FIG. 2.

Referring now to the drawings in detail, a packaging system 10 provided by the present invention provides incompletely-severed dunnage products that resist the shingling, alignment, and sequencing problems that can occur with separated dunnage products. In particular, the packaging system 10 includes a dunnage conversion machine 12 that converts a sheet stock material 14 into a lower-density strip of dunnage, and then partially cuts the strip of dunnage at desired lengths to create individual or discrete dunnage products, sometimes referred to as pads 16, that remain attached to the strip until ready for use. The connected dunnage products are easier to deliver to a packer in the sequence in which the dunnage products 16 were produced.

More particularly, the packaging system 10 includes a stock supply assembly 15, the dunnage conversion machine 12, and an accumulator adapted to receive multiple dunnage products or pads 16 until ready for use by a packer. The dunnage conversion machine 12 draws the sheet stock material 14 from the stock supply assembly 15 in a downstream direction. The downstream direction is the general direction the stock material 14 moves through the conversion machine 12 and is generally indicated by the illustrated arrow 20. A longitudinal dimension of the strip of dunnage is generally parallel to the downstream direction. The upstream direction is opposite the downstream direction. Thus, the dunnage conversion machine 12 is downstream of the stock supply assembly 15, and the stock supply assembly 15 is upstream of the dunnage conversion machine 12.

The stock supply assembly 15 includes a supply of sheet stock material 14, generally provided in a compact configuration, such as a roll of stock material or a generally rectangular stack of fan-folded stock material. The sheet stock material 14 includes one or more plies of sheet material. An exemplary sheet stock material 14 is made of paper, such as kraft paper, for example thirty-pound basis weight kraft paper. Paper is biodegradeable, recyclable, and composed of a renewable resource, making it an environmentally-responsible choice. But the present invention is not limited to use with paper. One or more of the plies may be made of another type of sheet material, such as a plastic sheet, or different types of paper, such as printed paper, bleached paper, fifty-pound kraft paper, or other sheet material, or combinations thereof. Because paper is reusable, recyclable, and composed of a renewable resource, it is an environmentally responsible choice as a stock material for conversion into a dunnage product.

The dunnage conversion machine 12 typically includes a conversion assembly 22 that converts the sheet stock material 14 into the relatively lower density strip of dunnage (lower density than the sheet stock material 14 from which the strip of dunnage is formed), a cutting assembly 24 that cuts the strip of dunnage to form individual dunnage products 16 having a desired length, and a controller 26 that controls the operation of the cutting assembly 24. The cutting assembly 24 is downstream of the conversion assembly 22, and operates to define the length of the dunnage products 16 even though the cutting assembly 24 does not completely sever the dunnage products 16 from the strip of dunnage. The controller 26 also may control elements of the conversion assembly 22. An exemplary conversion assembly 22 converts the sheet stock material 14 into a randomly crumpled strip of dunnage is disclosed in U.S. Pat. No. 7,722,519, which is hereby incorporated herein in its entirety.

The strip of dunnage has a width and a height that is less than the width that generally correspond to the width and height, respectively, of an individual dunnage product 16. The strip of dunnage and dunnage products 16 also have a length, generally parallel to the downstream direction 20. The length of the strip of dunnage is limited only by the supply of sheet stock material 14, and the length of each dunnage product 16 is determined by the cutting assembly 24.

The controller 26 controls the cutting assembly 24 to only cut partially across the width of the strip of dunnage, either through configuration of the electronic control signals or through controlling the physical structure of the cutting assembly 24. As a result of this partial cut, the dunnage products 16 remain connected to the strip of dunnage, either directly or through intermediate dunnage products. The cuts are substantially continuous, and may be made from one side of the strip of dunnage across the width of the strip toward an opposite side, leaving a portion of the opposite side intact; or the cutting assembly 24 may cut the strip of dunnage from opposite sides toward a central portion, leaving the central portion uncut; or the cutting assembly 24 may cut the strip of dunnage in the middle, leaving uncut portions on In the illustrated system, the dunnage products 16 are dispensed from an outlet of the conversion machine 12 to an accumulator 28. The accumulator 28 is adapted to receive multiple dunnage products or pads 16 until a packer is ready to use the pads 16 in packing one or more articles in a container for shipment. The illustrated accumulator 28 includes a chute 30 or other guide surface, such as a conveyor. The illustrated chute 30 is upwardly inclined, and at the end of the chute 30 the leading pads 16 fall by gravity into a bin 32 or other receptacle, which also may be provided as part of the accumulator 28. The bin 32 has access openings 34 that facilitate retrieving pads 16 from the bin 32. Multiple access openings 34 facilitate use by multiple packers at separate packing stations.

The connected nature of the pads 16 means that the weight of the unsupported pads 16 hanging off the end of the chute 30 applies tension through the string of pads 16 and helps to keep the pads 16 aligned in the chute 30. The chute 30 and the bin 32 allow multiple pads 16 to accumulate until ready for use. The packer removes the pads 16 from the bin 30 and manually separates pads 16 from the connected strip as needed.

Put another way, the present invention provides a dunnage conversion machine 12 that includes both (a) means for converting a sheet stock material 14 into a lower density strip of dunnage having a width, and (b) means for cutting the strip of dunnage to form a discrete dunnage product 16 of a desired length by cutting across less than the width of the strip of dunnage to maintain a connection between the strip of dunnage and the discrete dunnage product 16. In the exemplary embodiment just described, an exemplary means for converting may include a conversion assembly 22 that converts the sheet stock material 14 into a lower-density strip of dunnage having a width. And an exemplary means for cutting may include both the cutting assembly 24 downstream of the conversion assembly 22 to cut the strip of dunnage to form a discrete dunnage product 16 of a desired length, and the controller 26 that controls the operation of the cutting assembly 24. The controller 26 may be configured to control the cutting assembly 24 to cut across less than the width of the strip of dunnage to maintain a connection between the strip of dunnage and the discrete dunnage product 16. And cutting assembly 24 includes a cutting blade with a cutting edge. The cutting assembly 24 may be configured structurally such that the cutting edge may only move across a portion of the width of the strip.

The connection between the connected pads 16 keeps the pads 16 aligned with each other as the pads move along the upwardly-inclined delivery chute 30. As the leading pads 16 fall into the bin 32, the weight of the unsupported connected pads 16 helps to keep a degree of tension (and therefore control) on the string of pads. Packers break the link holding the pads 16 to the string as they remove the pads 16 from the bin 32.

The dunnage conversion machine may further include elements that define a path for the strip of dunnage through the cutting assembly. And the cutting assembly may a cutting blade. The controller may control the cutting assembly to move the cutting blade into the path from a lateral side of the path.

The path may be configured to accommodate the width of the strip of dunnage extending between lateral sides of the path. The cutting assembly may be configured to cut between 25% and 95% of the path, the cutting assembly may be configured to cut between 40% and 80% of the path, and the cutting assembly may be configured to cut between 50% and 75% of the path.

The present invention further provides a method of making a dunnage product 16 that includes the following steps: (a) converting a sheet stock material 14 into a lower density strip of dunnage having a width and a height that is less than the width; and (b) cutting the strip of dunnage to form a discrete dunnage product 16 of a desired length by cutting across less than the width of the strip of dunnage to maintain a connection between the strip of dunnage and the discrete dunnage product 16.

The method may include moving a cutting blade across the width of the strip of dunnage. The method also may include the step of advancing the strip of dunnage in a longitudinal direction transverse the width of the strip of dunnage, and repeating the cutting step over time to form a series of longitudinally-spaced cuts that define a plurality of discrete dunnage products, each of a desired length, each connected to the strip of dunnage.

The cutting step may include cutting the strip of dunnage at longitudinally-spaced locations that are not equally spaced.

The method may include step of supplying a paper sheet stock material to a conversion assembly for the converting step.

The converting step may include randomly crumpling the sheet stock material.

The method may include the step of accumulating a plurality of discrete dunnage products connected to the strip of dunnage.

The method may include the step of separating a discrete dunnage product from the strip of dunnage. The separating step may be performed manually.

In summary, the present invention provides a method of making a dunnage product 16 that includes the following steps: (a) converting a sheet stock material 14 into a lower density strip of dunnage having a width and a height that is less than the width; and (b) cutting the strip of dunnage to form a discrete dunnage product 16 of a desired length by cutting across less than the width of the strip of dunnage to maintain a connection between the strip of dunnage and the discrete dunnage product 16. The connection between respective dunnage products 16 in a string of connected dunnage products keeps the dunnage products 16 together, in the order in which they were produced, and helps to ensure that the dunnage products 16 do not shingle and can assist in feeding the dunnage products 16 to a packing station.

Although the invention has been shown and described with respect to certain embodiments, it is obvious that equivalent alterations and modifications will occur to others skilled in the art upon the reading and understanding of this specification and the annexed drawings. In particular regard to the various functions performed by the above described components, the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention can have been disclosed with respect to only one of the several embodiments, such feature can be combined with one or more other features of the other embodiments as may be desired and advantageous for any given or particular application.

The invention claimed is:

1. A dunnage conversion machine comprising:

a conversion assembly that converts a sheet stock material into a lower-density strip of dunnage having a width and a height that is less than the width;

a cutting assembly downstream of the conversion assembly to cut the strip of dunnage to form a discrete dunnage product of a desired length; and a controller that controls the operation of the cutting assembly, the controller being configured to control the cutting assembly to selectively cut across the entire width of the strip of dunnage or to cut across less than the width of the strip of dunnage to maintain a connection between the strip of dunnage and the discrete dunnage product.

2. A dunnage conversion machine as set forth in claim 1, comprising elements that define a path for the strip of dunnage through the cutting assembly, and the cutting assembly includes a cutting blade.

3. A dunnage conversion machine as set forth in claim 2, where the controller controls the cutting assembly to move the cutting blade into the path from a lateral side of the path, the path configured to accommodate the width of the strip of dunnage extending between lateral sides of the path.

4. A dunnage conversion machine as set forth in claim 1, where the cutting assembly is configured to cut across less than the width of the strip of dunnage a distance between 25% and 95% of the width of the path.

5. A dunnage conversion machine as set forth in claim 1, where the cutting assembly is configured to cut across less than the width of the strip of dunnage a distance between 40% and 80% of the width of the path.

6. A dunnage conversion machine as set forth in claim 1, where the cutting assembly is configured to cut across less than the width of the strip of dunnage a distance between 50% and 75% of the width of the path.

7. A packaging system comprising the dunnage conversion machine of claim 1, and an accumulator adapted to receive multiple discrete dunnage products connected to the strip.

8. A packaging system as set forth in claim 7, where the accumulator includes a linear chute.

9. A packaging system as set forth in claim 7, where the accumulator includes a bin that can hold multiple discrete dunnage products connected to the strip.

10. A method of making a dunnage product, comprising the following steps:

converting a sheet stock material into a lower density strip of dunnage having a width and a height that is less than the width; and selectively cutting the strip of dunnage either by cutting across the entire width of the strip of dunnage to form a discrete dunnage product of a desired length separated from the strip of dunnage or by cutting across at least a portion of but less than the width of the strip of dunnage to maintain a connection between the strip of dunnage and the discrete dunnage product.

11. A method as set forth in claim 10, where the cutting step includes moving a cutting blade across the width of the strip of dunnage.

12. A method as set forth in claim 10, comprising the step of advancing the strip of dunnage in a longitudinal direction transverse the width of the strip of dunnage, and repeating the cutting step over time to form a series of longitudinally-spaced cuts that define a plurality of discrete dunnage products, each of a desired length, each connected to the strip of dunnage.

13. A method as set forth in claim 10, where the cutting step includes cutting the strip of dunnage at longitudinally-spaced locations that are not equally spaced.

14. A method as set forth in claim 10, comprising the step of supplying a paper sheet stock material to a conversion assembly for the converting step.

15. A method as set forth in claim 10, where the converting step includes randomly crumpling the sheet stock material.

16. A method as set forth in claim 10, comprising the step of accumulating a plurality of discrete dunnage products connected to the strip of dunnage.

17. A method as set forth in claim 10, comprising the step of separating a discrete dunnage product from the strip of dunnage.

18. A method as set forth in claim 17, where the separating step is performed manually.

* * * * *